United States Patent [19]

Buford et al.

[11] Patent Number: 4,846,112

[45] Date of Patent: Jul. 11, 1989

[54] FUEL BATH VOLUME COMPENSATOR FOR STORED CHEMICAL ENERGY POWER PROPULSION SYSTEM

[75] Inventors: John T. Buford, Rockford; Kerry M. Peters, Cherry Valley, both of Ill.

[73] Assignee: Sundstrand Corp., Rockford, Ill.

[21] Appl. No.: 223,569

[22] Filed: Jul. 25, 1988

[51] Int. Cl.[4] ..... F22B 1/00; F22B 3/00

[52] U.S. Cl. ..... 122/21; 110/320; 122/4 R

[58] Field of Search ..... 122/21, 4 R, 32; 60/39.464; 110/320

[56] References Cited

U.S. PATENT DOCUMENTS

| | | | |
|---|---|---|---|
| 3,087,451 | 4/1963 | Chandler | 122/21 X |
| 3,425,316 | 2/1969 | Egbert et al. | 122/21 X |
| 3,453,086 | 7/1969 | Harm | 23/282 |
| 4,199,545 | 4/1980 | Matovich | 422/112 |
| 4,490,048 | 12/1984 | Schlueter | 366/134 |
| 4,643,166 | 2/1987 | Hubele et al. | 122/21 X |
| 4,671,211 | 6/1987 | Buford | 122/21 X |
| 4,714,051 | 12/1987 | Buford | 122/21 |
| 4,771,738 | 9/1988 | Ewbank | 122/21 X |

*Primary Examiner*—Edward G. Favors

*Attorney, Agent, or Firm*—Antonelli, Terry & Wands

[57] ABSTRACT

An ullage compensator is disclosed for a stored chemical energy power propulsion system. With the invention, at least one movable wall (16) is provided within a reactor having a chamber (10) which is movable between a first position at which the chamber has a maximum reaction volume to a second position at which the reaction chamber has a minimum volume. A force is applied to the movable wall by a bellows to cause the wall to project into the chamber in response to the force when a reaction is occurring within the chamber. The invention eliminates damage to the interior surface of the chamber and the inlet port(s) for introducing an oxidant into the chamber which sustains the reaction caused by direct contact with a gaseous oxidant which causes the reaction.

14 Claims, 2 Drawing Sheets

FUEL BATH VOLUME COMPENSATOR FOR STORED CHEMICAL ENERGY POWER PROPULSION SYSTEM

TECHNICAL FIELD

The present invention relates to stored chemical energy exothermic reaction systems having a reactor chamber in which a molten metallic fuel is reacted with gaseous oxidant gas to create heat used in steam generation. More particularly, the present invention relates to stored chemical energy exothermic reaction systems of the foregoing type used in vehicular propulsion systems which have a controlled ullage in the reactor chamber.

BACKGROUND ART

U.S. Pat. No. 4,714,051, assigned to the assignee of the present invention, discloses a stored chemical energy power propulsion system having a reactor having a closed chamber in which lithium in the form of a body of lithium metal shot encapsulated in a thin layer of predominantly fluorine substituted polyolefin based polymeric material is reacted within the chamber with a gaseous oxidant such as $SF_6$. An exothermic reaction is initiated when the aforementioned lithium shot is melted in the presence of gaseous $SF_6$ which is introduced into the closed chamber via an inlet port. An initiator supplies sufficient thermal energy to the metallic lithium within the chamber to melt the encapsulated lithium which reacts initially with the polymeric material and thereafter in a highly exothermic manner to generate heat upon reaction with the $SF_6$. A heat exchanger, which is part of the chamber walls, converts water which is pumped to an inlet of the heat exchanger into superheated steam which is used for supplying propulsive power to a vehicle such as a torpedo. This system has approximately 75–80% of the volume of the chamber initially charged with the encapsulated lithium. The remainder of the volume contains the initiator and ullage to allow for temporary expansion of the fuel at the start of the reaction. The reaction has short pressure peak above ambient pressure followed by a highly exothermic reaction having pressures within the chamber below the ambient pressure. As the reaction is ongoing, the ullage within the chamber is occupied by a low pressure fuel vapor with solid reaction products being contained within the liquid metal.

While the foregoing system produces a high power output useful for the propelling of a vehicle such as a torpedo, the chemical reaction can cause damage or failure in the chamber walls when the attitude of the chamber rapidly changes consequent from vehicular motion or is varied substantially from a horizontal plane. Rapid changes in attitude or altitudes substantially varied from the horizontal plane cause the gaseous oxidant inside the chamber to move about the chamber and directly contact the chamber wall(s) and end plate including inlet port(s) for introducing the gaseous oxidant which is introduced into the reactor chamber at a metered rate to sustain the exothermic chemical reaction. When the interior of the chamber is directly exposed to the gaseous oxidant, an increase in the pressure occurs within the chamber and further the direct contact of the gaseous oxidant can corrode the interior wall(s) thereof or the inlet port(s) because the gaseous oxidant does not react sufficiently with the liquid lithium. The effects of these two occurrences can cause the chamber to rupture and fail.

DISCLOSURE OF THE INVENTION

The present invention solves the foregoing problem by minimizing the ullage within the chamber during the aforementioned exothermic reaction to prevent substantial direct exposure of the interior walls and end plate including inlet port(s) to the gaseous oxidant which is introduced into the chamber in metered quantities to sustain the exothermic reaction. The present invention continually reduces the ullage within the chamber as the reaction is ongoing to minimize direct exposure of the interior wall(s) and inlet port(s) to the gaseous oxidant. One or more movable walls continually decrease the interior volume of the chamber as the exothermic reaction proceeds toward completion when the fuel within the chamber is in a liquid phase to minimize the ullage to prevent the aforementioned direct exposure of the interior wall(s) and inlet port(s) of the chamber to the gaseous oxidant. The continual movement of the one or more movable walls during the reaction decreases the volume of the reactor chamber while sustaining an operating pressure within the chamber below a pressure at which the chamber would rupture and further reduces the ullage to a point where very little surface area of the interior wall(s) of the chamber or inlet port(s) can be exposed to the gaseous oxidant introduced into the chamber during rapid changes in attitude or altitudes varied substantially from the horizontal plane. Furthermore, the present invention promotes maximum heat transfer between the exothermic reaction occurring within the chamber and the heat exchanger within the chamber wall(s) by maintaining substantially complete surface contact of the liquid metal within the chamber during the reaction with the interior wall(s) of the chamber to efficiently transfer heat to the heat exchanger within the walls of the chamber. The maximized transfer of the thermal energy occurs to a fluid being circulated through the heat exchanger which is used to power a turbine driving a vehicle such as a torpedo.

A thermal energy generator in which first and second substances are reacted to produce an exothermic reaction in accordance with the invention comprises a closed chamber in which the substances are reacted to produce reaction products contained within the closed chamber with the first substance being disposed within the chamber prior to initiation of the reaction; at least one inlet port for permitting the second of the substances to be introduced into the chamber to sustain the reaction; an initiator disposed within the chamber for initiating the reaction within the chamber; and a mechanim for decreasing the reaction volume of the chamber after the reaction is initiated to minimize the ullage within the chamber to minimize direct contact of the second substance with the at least one inlet port and interior surface of the chamber. The variation in volume is preferably a controlled decreasing in volume as the reaction proceeds to completion. The mechanism for decreasing the volume of the chamber comprises at least one movable wall which projects into the closed chamber upon movement from a first position to a second position. A spring applies a force to the at least one movable wall within the chamber toward an interior part of the chamber. The first substance is solidified in the chamber prior to initiation of the reaction in contact with the at least one movable wall to hold the at least one movable wall in a first position at which the chamber has a maximum reaction volume, and upon commencement of the reaction causing the one substance in contact with the at least one movable wall to melt, the at least one movable wall is free to move from the first position to a second position at which the chamber has a minimum reaction volume. After an initial pressure peak, the force causes the reaction volume to continually decrease as the reaction is ongoing to minimize the ullage of the chamber during the reaction to preclude substantial direct exposure of the inlet port(s) or interior surfaces of the chamber to the second substance introduced into the chamber. Furthermore, a heat exchanger is within the chamber wall(s) for conducting heat created by the exothermic reaction away from the chamber by a fluid circulated through the heat exchanger. Furthermore, a connecting wall connects the at least one movable wall to the chamber with each connecting wall containing a bellows which expands from a first compressed dimension to a second dimension when the movable wall moves from the first position to the second position. Preferably, the spring in each of the connecting walls is the bellows. During the reaction, each bellows causes the movable wall to move from the first position toward the second position to a position where gas pressure within the chamber is balanced with ambient gas pressure outside the chamber and the spring bias to minimize the ullage within the chamber to preclude substantial direct exposure of the inlet port(s) or interior surfaces of the chamber to the substance introduced into the chamber.

A thermal energy generator in which first and second substances are reacted to produce an exothermic reaction in accordance with the invention comprises a closed chamber in which the substances are reacted to produce reaction products contained within the closed chamber; at least one movable wall contained within the closed chamber which is movable between first and second positions with the first position providing a maximum reaction volume in the chamber, movement from the first position to the second position decreasing the reaction volume of the chamber and the second position of the at least one wall providing a minimum reaction volume in the chamber; a spring applies a force to the at least one movable wall toward an interior part of the chamber; an inlet port for permitting the second substance to be introduced into the chamber; the first substance being solidified in the chamber prior to initiation of the reaction in contact with the at least one movable wall to hold the at least one movable wall in the first position and upon commencement of the reaction causing the first substance in contact with the at least one movable wall to melt, the at least one movable wall is free to move between the first and second positions to control the ullage within the chamber during the reaction to minimize direct exposure of the at least the inlet port or an interior surface of the chamber to the second substance; and an initiator disposed in the chamber for initiating the reaction within the chamber. The spring causes the reaction volume of the chamber to continually decrease as the reaction proceeds to completion to minimize ullage within the chamber to minimize direct contact of the second substance with at least one inlet port and an interior surface of the chamber. Furthermore, the invention includes a heat exchanger in thermal contact with the chamber for conducting heat created by the exothermic reaction away from the chamber by a fluid circulated through the heat exchanger. A connecting wall connects each of the at least one movable walls to the chamber, each connecting wall containing a bellows which increases from a first compressed dimension to a second expanded dimension when the movable wall moves from the first position to the second position. The spring is preferably the bellows. Each bellows causes a connected movable wall to move from the first position toward the second position to a position where gas pressure within the chamber is balanced with ambient gas pressure outside the chamber and the spring bias to minimize ullage within the chamber to minimize direct exposure of the at least one inlet port or the interior surface of the chamber to the second substance introduced into the chamber.

BEST MODE FOR CARRYING OUT THE INVENTION

Figure 1:
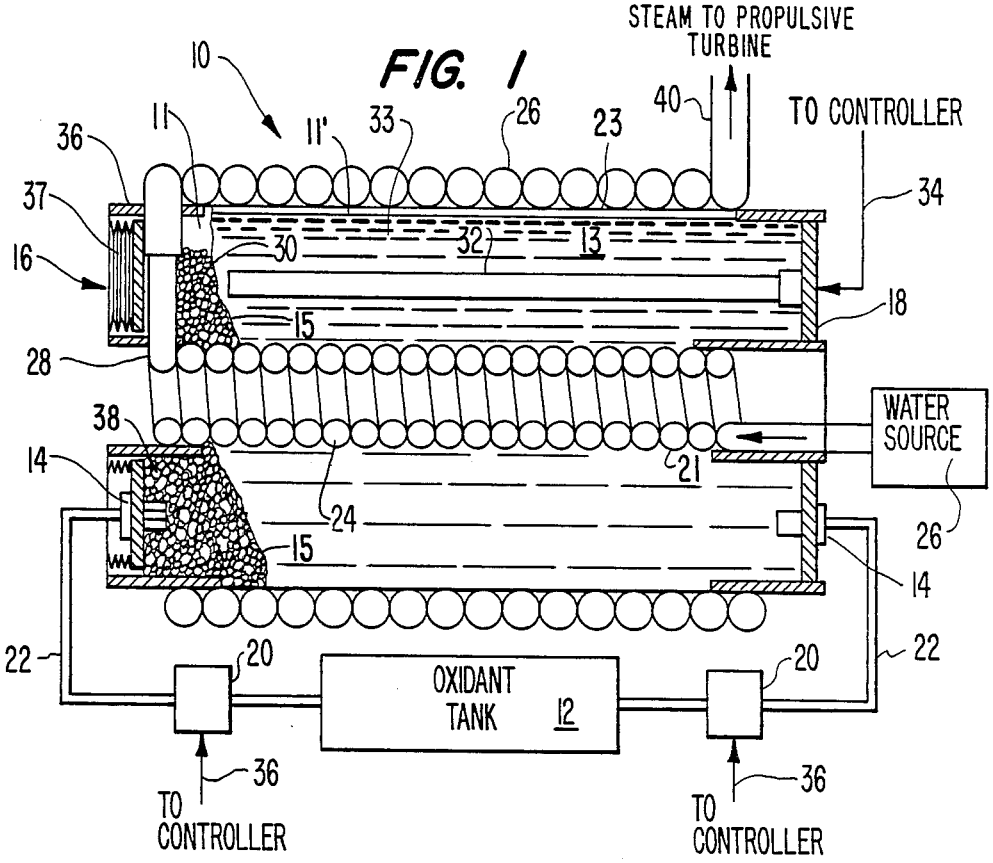
FIG. 1 illustrates the invention prior to initiation and during the reaction.

FIG. 1 illustrates a thermal energy generation system in accordance with the present invention prior to and during an exothermic reaction within an annular reactor having a chamber 10. Prior to initiation of the exothermic reaction, the chamber 10 contains pellets of encapsulated metallic fuel 30 such as those disclosed in U.S. Pat. No. 4,714,051 with an ullage 11 of typically 20%. It should be understood that the ullage 11 would actually extend across the chamber prior to initiation of the reaction with the portion of the chamber 10 to the left of line 15, as illustrated, being the chamber prior to reaction and the portion of the chamber to the right of line 15 being the chamber during the reaction. The interior of the chamber is the reaction volume. Furthermore, during the reaction, the ullage 11' is minimized as much as possible to cause the liquid reactants to be in complete surface contact with all interior surfaces of the annular chamber to minimize direct contact of the gaseous oxidant with the interior surfaces or with the inlet ports 14 for introducing the gaseous oxidant into the chamber.

During the exothermic reaction, the metallic fuel is in a liquid state as identified by reference numeral 13. During the ongoing reaction, the pressure within the chamber 10 in the ullage 11' is low as a consequence of the nature of the exothermic reaction in which the reaction products are contained within the liquid metal 13 with the volume of the reaction products and unconsumed liquid metal continually shrinking as the reaction proceeds to completion at which point all of the metal has been reacted. The minimal ullage 11' eliminates the prior art problem of substantial direct contact of the interior surface of the reaction chamber or inlet port(s) with gaseous oxidant during rapid changes in attitude consequent from vehicular motion or orientations tipped substantially from the horizontal plane. The closed chamber 10 defines a reaction volume in which pelletized metallic fuel 30 is liquified and reacted with gaseous oxidant which is stored in an oxidant tank 12 that is introduced into the chamber 10 through inlet ports 14. It should be understood that any number of inlet ports 14 may be provided in the annular end walls 16 and 18. Valves 20 are disposed in conduits 22 which connect the oxidant tank 12 to the inlet ports 14. It should be understood that flexible sections in the conduits 22 have been omitted but should be included where necessary to accommodate movement of the wall 16. The supply of the gaseous oxidant from the oxidant tank 12 to the inlet ports 14 may be implemented in any suitable manner such as disclosed in the aforementioned U.S. Pat. No. 4,714,051 and do not form part of the present invention.

Figure 3:
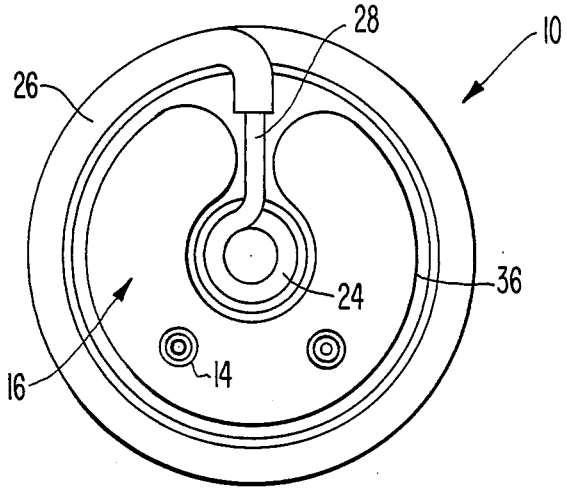
FIG. 3 is an end view of the crossover pipe of the heat exchanger connecting inner and outer helixes of the heat exchanger.

The chamber 10 contains a heat exchanger within the inner cylindrical wall 21 and the outer cylindrical wall 23. The heat exchanger comprises a central helical fluid conducting coil 24 which is connected to a water source 26 that supplies water which is pumped into the heat exchanger and converted to steam to carry away the heat generated by the exothermic reaction occurring within the reaction chamber 10, concentric exterior coil 26, and connecting crossover pipe 28. Each of the turns of the central helical coil 24 are welded together to form a fluid tight seal with the inner cylindrical wall 21 of the reaction chamber 10. The central helical coil 24 may be made from any metallic material having the requisite chemical inertness to withstand the reaction products of the exothermic reaction and to further withstand the high thermal energy generated within the reaction chamber 10. The central helical coil 24 is connected to the concentric exterior helical coil 26 by means of the crossover pipe 28 as illustrated in FIG. 3. The crossover pipe 28 contains an adaptor 29 which changes from the smaller interior diameter of the central helical coil 24 to the larger inner diameter of the exterior helical coil 26. The increase in diameter provided by the adaptor 29 is utilized to permit the requisite flow of superheated steam through the exterior helical coil 26 to permit sufficient thermal transfer from the reaction chamber 10 to superheated steam flowing in the exterior helical coil. The water pumped into the heat exchanger from water source 26 changes to superheated steam at approximately the end of the central helical coil 24 just before crossover to the exterior coil 26 by means of the crossover pipe 28. Each of the turns of the exterior coil 26 are welded together to form the fluid tight exterior wall 23 to contain the reaction products. As illustrated, the encapsulated metal 11 prior to initiation of the reaction fills approximately 75–80% of the volume of the chamber with initiator 32 displacing some of the remaining volume and the remainder being ullage 11 as illustrated to the left of line 15. Initiator 32, may be any known initiator which provides sufficient thermal energy to change the encapsulated solid metal pellets to a liquid state indicated as 13 at which the chemical reaction between the gaseous oxidant and the liquid metal takes place. The initiator 32 may be detonated by a signal from a controller (not illustrated) which is applied by means of wire 34. Similarly, the valves 20 are controlled by the controller by means of signals applied on wires 36.

Figure 4:
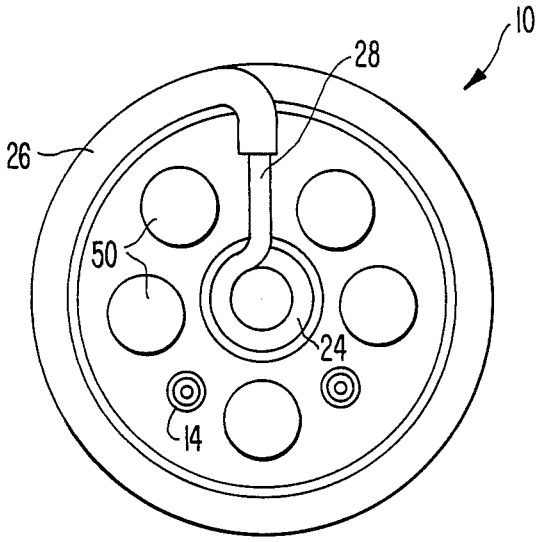
FIG. 4 is an end view of another embodiment of the invention having a plurality of movable walls mounted within a fixed end plate.

Control of the ullage 11' during the reaction within the chamber 10 is produced by one or more movable walls 16 which are movable from a first position at which the reaction volume of the chamber is a maximum to a second position at which the reaction volume of the chamber is a minimum. As illustrated, the left-hand end wall 16 is within a recess defined by a closed connecting wall 37. It should be further understood that the present invention may be equally implemented by a number of smaller movable walls located in different portions of the chamber 10, for example, while not being limited thereto, as illustrated in FIG. 4 described below. The closed connecting wall 37 contains a bellows which may be fabricated from any suitable metallic material having the inertness to withstand the reaction products and heat generated within the chamber and further which functions as a compressed spring at the temperature of the reaction and has a spring rate which minimizes the ullage 11' within the chamber when the encapsulated lithium 30 within the chamber is converted to the liquid state 13 to minimize direct exposure of the interior walls of the reaction chamber 10 or inlet ports 14 to the gaseous oxidant during rapid changes in attitude or orientations tipped substantially from the horizontal. It should be further understood that the spring function of the bellows of the present invention further maximizes heat transfer from the reaction chamber 10 to the central coil 24 and exterior coil 26 of the heat exchanger as a consequence of maximizing direct surface area exposure of the walls of the chamber 10 to the liquid metal 13 during the reaction by minimizing the ullage 11'. The bellows may be made of the same materials from which the end plate 18 and the continuous wall 36 are made.

Figure 2:
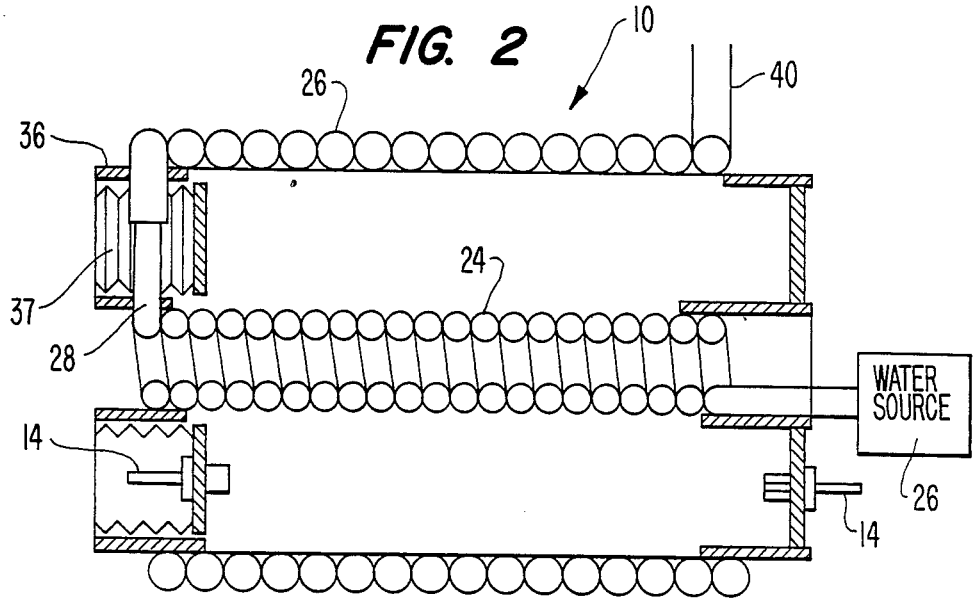
FIG. 2 is a view of the invention after the reaction has been completed.

Operation of the present invention to control ullage 11' within the reaction chamber 10 to minimize direct exposure of the interior walls of the chamber and the inlet port(s) 14 to gaseous oxidants, such as $SF_6$, during rapid attitude changes or orientations tipped substantially from the horizontal and to maximize heat transfer to the fluid (water and superheated steam) flowing in the central helical coil 24 and exterior helical coil 26 of the heat exchanger is as follows. Initiation of the reaction is caused by activation of the initiator 32 which changes enough of the encapsulated metal 30 within the chamber 10 to melt so that introduction of gaseous oxidant from the oxidant tank 12 through the inlet ports 14 sustains the reaction. As soon as the reaction is commenced, the metallic pellets 30 change to liquid 13. The controller (not illustrated) controls the valves 36 and other controls not illustrated to meter the introduction of the gaseous oxidant into the interior of the chamber 10 at a rate to produce the desired quantity of thermal energy. As the reaction is ongoing, the resultant liquid metal fuel and combustion products continually decrease in volume from the volume of the initial charge of lithium pellets 30 within the chamber and furthermore the gas pressure within the chamber is sufficiently low that the compressed spring characteristic of the one or more bellows which are part of the one or more movable walls 16 move from their maximum compressed state at which the interior reaction volume of the chamber is maximized by the metal pellets 30 holding the bellows in the first position toward the second position at which the chamber 10 has a minimum volume as illustrated in FIG. 2. It should be understood that like reference numerals identify like parts in FIGS. 1 and 2 with FIG. 2 having been simplified to merely illustrate the second position of the end wall 16 at which the reaction volume of the chamber 10 is minimized without illustrating the structures exterior to the chamber or the end reaction products within the chamber. During the reaction, the bellows within wall 37 continually expands such that the pressure of the interior of the chamber 10 balances the force applied by the spring function of bellows and the ambient atmospheric pressure. The spring rate is chosen to achieve the desired minimal ullage 11' within the reaction chamber 10 during the reaction with consideration being given to the lessening of spring rate of metals as a function of increased temperature for the material used for fabricating the bellows. When the reaction is completed, as illustrated in FIG. 2, the metallic charge is reacted with reaction products (not illustrated) being contained within the closed chamber 10 having its minimum volume. During the reaction, the rate of energy transfer from the exothermic reaction occurring within the reaction chamber 10 is regulated by the amount of water which is pumped from the water source 26 of FIG. 1. The water typically changes to steam at the end of the central helical coil 24 in proximity to the crossover 28. Superheated steam flows through the exterior helical coil 26 to discharge port 40 which is connected to a turbine (not illustrated) for providing propulsive power to a vehicle such as a torpedo. It should be understood that during movement of the end wall 16 from its first position at which the reaction chamber 10 has a maximum reaction volume to its second position, as illustrated in FIG. 2, at which the chamber has a minimum reaction volume, the ullage 11' within the chamber is minimized so that the chamber is sufficiently full of the liquid metal 13 during the reaction to prevent the substantial direct exposure of the interior walls and inlet ports 14 to the gaseous oxidant which can cause damage or destroy the chamber and inlet ports as in the prior art. Accordingly, during the ongoing reaction at which the reaction volume of the chamber 10 is continually decreasing under the spring bias applied by the bellows within wall 37, rapid changes in attitude from the horizontal caused by vehicular motion or attitudes tipped substantially from the horizontal will not substantially expose the inlet ports 14 or the interior walls of the chamber directly to the highly reactive oxidant gas.

It should be understood that the spring rate which is chosen for the bellows within wall 37 controls the force applied to the movable wall 16 against liquid metal and ullage 11' within the chamber 10 during the reaction. The higher the spring rate, the smaller the ullage 11'.

FIG. 4 illustrates an end view of another embodiment of the present invention which has a plurality of movable walls 50 located within a fixed end plate 52 in place of the single movable wall 16 of the embodiment illustrated in FIGS. 1–3. Like parts identify like parts in FIGS. 1–4. Each of the movable walls 50 may be biased to move within a cylindrical recess extending into the reaction chamber 10 upon initiation of the reaction from the fixed end plate 52 by a bellows like the bellows described above within wall 37. The embodiment of the invention in FIG. 4 is not limited to the configuration as illustrated with the position, shape and area of the movable walls being variable. Furthermore, the movable walls 50 may be located in any portion of the chamber 10 to project into the chamber to decrease ullage 11'.

While the present invention has been described in terms of its preferred embodiment, it should be understood that numerous modifications may be made thereto without departing from the spirit and scope of the present invention. While the preferred shape of the chamber 10 is annular, it should be understood that other shapes may be utilized within the scope of the present invention with one or more movable walls being provided within reactors having chambers of differing shape to decrease the volume of the chamber during the reaction to control the ullage 11' and minimize exposure of the inlet ports 14 and walls of the chamber to the gaseous oxidants.

Furthermore, while the preferred reactive system is based upon the reaction of lithium with $SF_6$, it should be understood that other exothermic reaction systems may be utilized in practicing the present invention in which the reaction is produced within a closed chamber with the reaction products being contained within the chamber under conditions that the volume of the reaction products and unspent fuel within the chamber is continually shrinking during the reaction.

We claim:

1. A thermal energy generator in which first and second substances are reacted to produce an exothermic reaction comprising:

a closed chamber in which the substances are reacted to produce reaction products contained within the closed chamber with the first substance being disposed within the chamber prior to initiation of the reaction;

at least one inlet port for permitting the second of the substances to be introduced into the chamber;

at least one movable wall contained within the closed chamber which is movable between first and second positions with the first position providing a maximum reaction volume within the chamber, movement from the first position to the second position decreasing the reaction volume of the chamber and the second position of the at least one wall providing a minimum reaction volume in the chamber;

means applying a force to the at least one movable wall toward an interior part of the chamber;

the first substance being solidified in the chamber, prior to initiation of the reaction, in contact with the at least one movable wall to hold the at least one movable wall in the first position while the one substance is solidified, and upon commencement of the reaction causing the first substance in contact with at least one movable wall to melt, the at least one movable wall is free to move between the first and second positions to control the ullage within the chamber during the reaction; and means disposed in the chamber for initiating the reaction within the chamber.

2. A thermal energy generator in accordance with claim 1 wherein:

the means applying a force causes the reaction volume of the chamber to continually decrease as the reaction proceeds to completion to minimize the ullage within the chamber to minimize direct contact of the second substance with at least one inlet port and an interior surface of the chamber.

3. A thermal energy generator in accordance with claim 2 further comprising:

a heat exchanger in thermal contact with the chamber for conducting heat created by the exothermic reaction away from the chamber by a fluid circulated through the heat exchanger.

4. A thermal energy generator in accordance with claim 3 further comprising:

a connecting wall connecting the at least one movable wall to the chamber, each connecting wall containing a bellows which expands from a first dimension to a second dimension when an associated movable wall moves from the first position to the second position.

5. A thermal energy generator in accordance with claim 4 wherein:

the means applying a force comprises the bellows.

6. A thermal energy generator in accordance with claim 5 wherein:

each bellows causes the associated movable wall to move toward the second position to a position where gas pressure within the chamber is balanced with gas pressure outside the chamber and force applied by the bellows to minimize the ullage within the chamber when the first substance is in a liquid state.

7. A thermal energy generator in which first and second substances are reacted to produce an exothermic reaction comprising:

a closed chamber in which the substances are reacted in a reaction volume to produce reaction products contained within the closed chamber with the first of the substances being within the chamber prior to introduction of the second substance into the chamber;

at least one inlet port for permitting the second of the substances to be introduced into the chamber to sustain the reaction;

means disposed within the chamber for initiating the reaction within the chamber; and means for decreasing the reaction volume of the chamber after the reaction is initiated to minimize the ullage within the chamber to minimize direct contact of the second substance with the at least one inlet port and an interior surface of the closed chamber.

8. A thermal energy generator in accordance with claim 7 wherein:

the means for decreasing the reaction volume continually reduces the reaction volume of the chamber as the exothermic reaction proceeds to completion.

9. A thermal energy generator in accordance with claim 8 wherein:

the means for decreasing the volume of the chamber comprises at least one movable wall which projects into the closed chamber upon movement from a first position to a second position.

10. A thermal energy generator in accordance with claim 9 wherein:

the means for decreasing reaction volume comprises means for applying a force to at least one movable wall within the chamber toward an interior part of the chamber;

the first substance is solidified in the chamber, prior to initiation of the reaction, in contact with the at least one movable wall to hold the at least one movable wall in a first position at which the chamber has a maximum reaction volume when the substance is solidified, and upon commencement of the reaction causing the second substance in contact with the at least one movable wall to melt, the at least one movable wall is free to move between the first position to a second position at which the chamber has a minimum reaction volume; and the means for applying a force decreases the reaction volume of the chamber during the reaction to minimize the ullage of the chamber during the reaction.

11. A thermal energy generator in accordance with claim 10 further comprising:

a heat exchanger in thermal contact with the chamber for conducting heat created by the exothermic reaction away from the chamber by a fluid circulated through the heat exchanger.

12. A thermal energy generator in accordance with claim 11 further comprising:

a connecting wall connecting each at least one movable wall to the chamber, each connecting wall containing a bellows which expands from a first dimension to a second dimension when the movable wall moves from the first position to the second position.

13. A thermal energy generator in accordance with claim 12 wherein:

the means for applying a force is the bellows in each connecting wall.

14. A thermal energy generator in accordance with claim 13 wherein:

each bellows causes the connecting wall containing each bellows to move toward the second position to a position where gas pressure within the chamber is balanced with gas pressure outside the chamber and force applied by the bellows to minimize the ullage within the chamber.

* * * * *